US008646900B2

(12) United States Patent
Kondo et al.

(10) Patent No.: US 8,646,900 B2
(45) Date of Patent: Feb. 11, 2014

(54) PRINTING DEVICE AND PRINTING METHOD

(75) Inventors: Takamitsu Kondo, Nagano (JP); Toru Takahashi, Nagano (JP); Hiroshi Wada, Nagano (JP); Kazuyoshi Tanase, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 336 days.

(21) Appl. No.: 13/252,333

(22) Filed: Oct. 4, 2011

(65) Prior Publication Data

US 2012/0081451 A1 Apr. 5, 2012

(30) Foreign Application Priority Data

Oct. 5, 2010 (JP) ..... 2010-225961

(51) Int. Cl.

| | |
|---|---|
| ***B41J 29/393*** | (2006.01) |
| ***B41J 2/01*** | (2006.01) |
| ***B41J 11/00*** | (2006.01) |
| ***B41J 2/36*** | (2006.01) |

(52) U.S. Cl.

CPC *B41J 11/002* (2013.01); *B41J 2/36* (2013.01); *B41J 2/362* (2013.01); *B41J 29/393* (2013.01)

USPC ..... 347/102; 347/19

(58) Field of Classification Search

USPC ..... 347/19, 102

See application file for complete search history.

(56) References Cited

U.S. PATENT DOCUMENTS

| | | | | |
|---|---|---|---|---|
| 7,748,838 | B2 * | 7/2010 | Oishi | 347/102 |
| 7,766,472 | B2 * | 8/2010 | Oishi | 347/102 |
| 2005/0185012 | A1 | 8/2005 | Yoshida | |
| 2006/0028523 | A1 * | 2/2006 | Hoshino | 347/102 |

FOREIGN PATENT DOCUMENTS

| | | | |
|---|---|---|---|
| JP | 06-344623 | A | 12/1994 |
| JP | 2005-205691 | A | 8/2005 |
| JP | 2010-112073 | A | 5/2010 |

* cited by examiner

*Primary Examiner* — Julian Huffman

(74) *Attorney, Agent, or Firm* — Global IP Counselors, LLP

(57) ABSTRACT

A printing device includes a head having a nozzle row in which a plurality of nozzles for ejecting ink that hardens under emission of light are arranged, the head being adapted for ejecting the ink from the nozzle row onto a medium that undergoes a relative movement, thereby forming a plurality of dot lines; a light source for emitting light; an adjusting part for adjusting a distance between the head and the light source; a detecting part for detecting a dot width of a given dot line; correction data in which a concentration correction value is defined for every dot line; and a memory part for storing a dot width of the given dot line in relation to when the correction data was created; wherein the distance between the head and the light source is adjusted.

11 Claims, 16 Drawing Sheets

| | Concentration Correction Value | | | | | |
|---|---|---|---|---|---|---|
| Raster Line | Ha | Hb | Hc | Hd | He | Hf |
| 1 | | | | | | |
| 2 | | | | | | |
| 3 | | | | | | |
| 4 | | | | | | |
| 5 | | | | | | |
| 6 | | | | | | |
| 7 | | | | | | |
| 8 | | | | | | |
| 9 | | | | | | |
| 10 | | | | | | |
| ⋮ | | | | | | |

Fig. 9

PRINTING DEVICE AND PRINTING METHOD

CROSS-REFERENCE TO RELATED APPLICATIONS

This application claims priority to Japanese Patent Application No. 2010-225961 filed on Oct. 5, 2010. The entire disclosure of Japanese Patent Application No. 2010-225961 is hereby incorporated herein by reference.

BACKGROUND

1. Technological Field

The present invention relates to a printing device and a printing method.

2. Background Technology

When an image is formed on a medium (e.g., paper) using, e.g., an ink-jet printer or another printing device, stripe-shaped concentration irregularities may occur on the image. Accordingly, there exists a technique in which the printing device is used to print a correction pattern in relation to each ink color; a scanner or a similar device is used to read the correction pattern; a concentration-correction value is calculated based on color information that is obtained as a result; and concentration is corrected (e.g., see Patent Citation 1).

Japanese Patent Application Publication No. 2005-205691 (Patent Citation 1) is an example of the related art.

SUMMARY

Problems to Be Solved by the Invention

The manner in which the concentration irregularities appear may differ according to the printing conditions. For example, if the type of medium is different, there is a possibility that the size of dots (i.e., dot width) formed by each nozzle will be different, even when the amount of ejected ink is the same.

For example, in an instance in which there is used ink that hardens when ultraviolet (UV) rays, which is one type of light, are emitted thereon (i.e., UV ink), the size of the dot varies according to the timing at which the ink is subjected to emission of UV. In such an instance, the manner in which the concentration irregularities appear varies, and there is a risk that the concentration irregularities cannot be reduced even if a concentration-correction value, calculated as described above, is used. Also, repeatedly creating new data relating to the concentration-correction value (i.e., correction data) for individual printing conditions takes time and effort.

An advantage of the present is to reduce concentration irregularities without repeating the creation of correction data.

Means Used to Solve the Above-Mentioned Problems

A principal aspect of the invention in order to achieve the above-mentioned object consists in a printing device, characterized in including a head having a nozzle row in which a plurality of nozzles for ejecting ink that hardens under emission of light are arranged in a predetermined direction, the head being adapted for ejecting the ink from the nozzle row onto a medium that undergoes a relative movement in an intersecting direction that intersects the predetermined direction, thereby forming in the predetermined direction a plurality of dot lines, in which a plurality of dots are arranged in the intersecting direction;

a light source for emitting light onto the dots formed on the medium by the head;

an adjusting part for adjusting a distance between the head and the light source;

a detecting part for detecting a dot width, in the predetermined direction, of a given dot line; and a memory part for storing correction data, in which a concentration correction value is defined for every dot line, and a dot width, in the predetermined direction, of the given dot line in relation to when the correction data was created; wherein the distance between the head and the light source is adjusted so that the dot width detected by the detecting part becomes equal to the dot width stored in the memory part.

Other characteristics of the invention will be made apparent in the present specifications and the accompanying drawings.

BRIEF DESCRIPTION OF THE DRAWINGS

Referring now to the attached drawings which form a part of this original disclosure:

FIG. 9 is a drawing showing a correction value table;

DETAILED DESCRIPTION OF EXEMPLARY EMBODIMENTS

Figure 1:
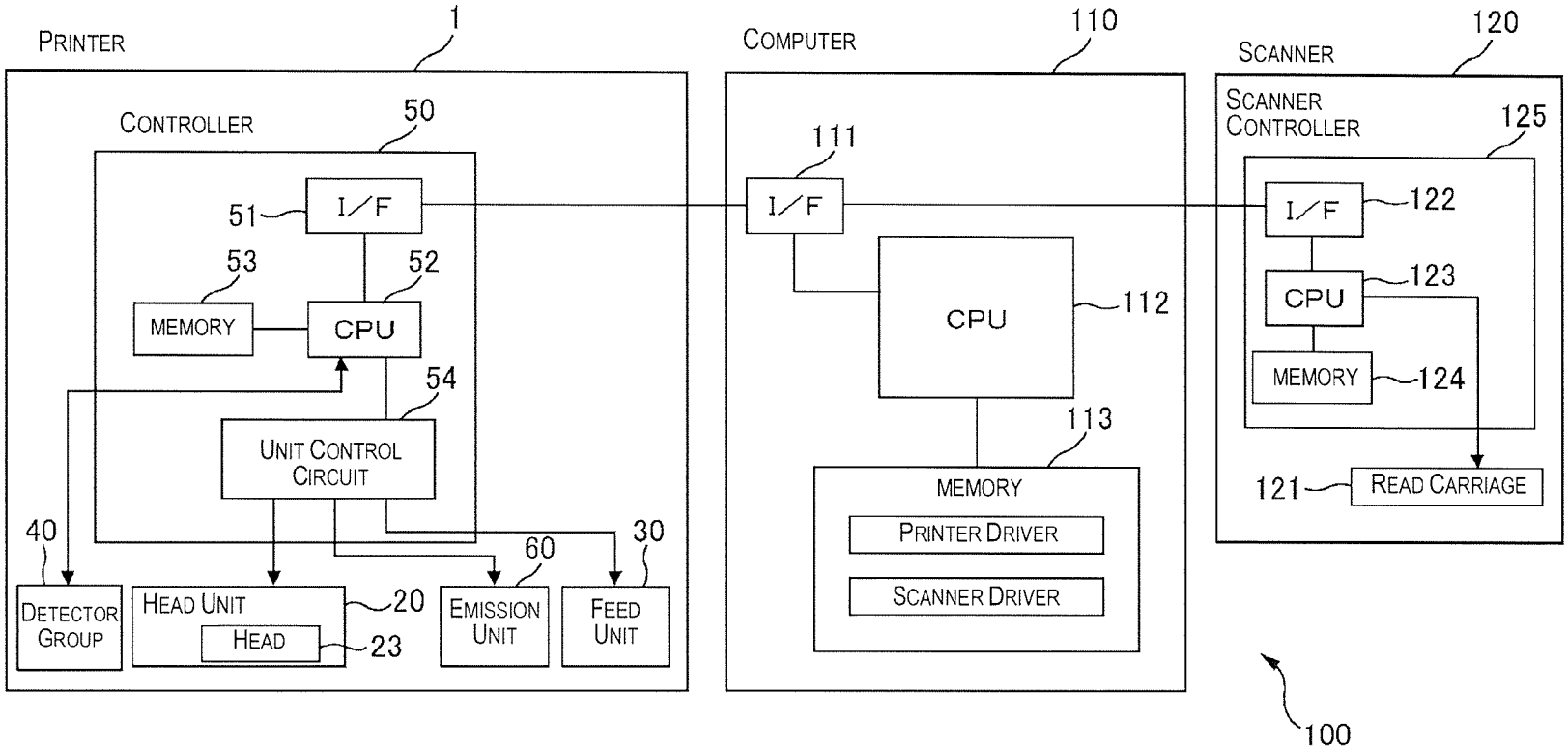
FIG. 1 is a block diagram showing a configuration of a printing system.

At least the following matter is made apparent by the present specifications and the accompanying drawings.

There is made apparent a printing device, including a head having a nozzle row in which a plurality of nozzles for ejecting ink that hardens under emission of light are arranged in a predetermined direction, the head being adapted for ejecting the ink from the nozzle row onto a medium that undergoes a relative movement in an intersecting direction that intersects the predetermined direction, thereby forming in the predetermined direction a plurality of dot lines, in which a plurality of dots are arranged in the intersecting direction;

a light source for emitting light onto the dots formed on the medium by the head;

an adjusting part for adjusting a distance between the head and the light source; a detecting part for detecting a dot width, in the predetermined direction, of a given dot line; and a memory part for storing correction data, in which a concentration correction value is defined for every dot line, and a dot width, in the predetermined direction, of the given dot line in relation to when the correction data was created; wherein the distance between the head and the light source is adjusted so that the dot width detected by the detecting part becomes equal to the dot width stored in the memory part.

According to a printing device of such description, concentration irregularities can be reduced without the creation of correction data being repeated, even in an instance in which there has been a change in the medium or another printing condition.

In the printing device, it is preferable that the given dot line is formed on the medium while the head and the light source are moved, relative to each other, in the intersecting direction.

According to a printing device of such description, it is possible to prevent the medium from being wastefully consumed when the distance between the head and the light source is adjusted.

In the printing device, it is preferable that a plurality of the heads are provided so as to be arranged in the intersecting direction; and the distance between a given head, from among the plurality of heads arranged in the intersecting direction, and the light source is adjusted.

According to a printing device of such description, it is possible to define the position of the light source using one head from among the heads.

In the printing device, it is preferable that an amount of ink ejected from a head other than the given head is modified according to the distance between the given head and the light source.

According to a printing device of such description, it is possible to adjust the dot width formed by a head other than the given head, whereby making it possible to inhibit concentration irregularities.

In the printing device, the given head and the head other than the given head may have different driving voltages or driving waveforms.

Also, in the printing device, the given head may be a head positioned at a center in the intersecting direction, from among the plurality of heads arranged in the intersecting direction.

Also, in the printing device, the driving voltage may differ between a forward pass and a reverse pass with regards to the relative movement of the head and the light source in the intersecting direction.

Also, in the printing device, the speed of movement of the light source may be less than the speed of movement of the head.

In the printing device, the light source may be tilted so that the distance from the head may differ towards one end and towards another end in the predetermined direction, a plurality of dot lines may be formed by the nozzles of the nozzle row, a respective dot width of each of the dot lines may be detected by the detecting part, and the distance between the head and the light source may be adjusted based on a result of the detection.

According to a printing device of such description, the distance between the head and the light source may be adjusted in a simple manner.

In the printing device, it is preferable that a plurality of the heads are provided in the predetermined direction; a plurality of the emitters are provided in the predetermined direction so as to correspond to each of the heads; and each of the respective distances between a corresponding head and light source is adjusted.

According to a printing device of such description, it is possible to minimize discrepancies between the heads.

There is also made apparent a method for printing using a printing device including a head having a nozzle row in which a plurality of nozzles for ejecting ink that hardens under emission of light are arranged in a predetermined direction, the head being adapted for ejecting the ink from the nozzle row onto a medium that undergoes a relative movement in an intersecting direction that intersects the predetermined direction, thereby forming in the predetermined direction a plurality of dot lines, in which a plurality of dots are arranged in the intersecting direction;

a light source for emitting light onto the dots formed on the medium by the head; and a memory part;

the method for printing characterized in including storing in the memory part correction data, in which a concentration correction value is defined for every dot line, and a dot width, in the predetermined direction, of a given dot line in relation to when the correction data was created;

detecting a dot width, in the predetermined direction, of the given dot line formed on a printing medium; and adjusting a distance between the head and the light source so that the detected dot width becomes equal to the dot width stored in the memory part.

(Printing System)

An overview of a printing system 100 for forming an image on a medium will now be given with reference to FIG. 1. FIG. 1 is a block diagram showing a configuration of the printing system 100.

As shown in FIG. 1, the printing system 100 of the present embodiment is a system including a printer 1, a computer 110, and a scanner 120.

The printer 1 is a device for ejecting a liquid onto a medium and forming an image (dot) onto the medium, and in the present embodiment, is a color ink-jet printer. The printer 1 according to the present embodiment is a device for ejecting UV-hardening ink ("UV ink" hereafter), which hardens when ultraviolet rays ("UV" hereafter), which is a type of light, are emitted thereon; and thereby prints an image onto the medium. The printer 1 is capable of printing an image on a plurality of types of medium, such as paper, cloth, film sheet, or another medium. UV ink is ink that contains a UV-hardening resin. When subjected to emission of UV, the UV-hardening resin undergoes a photopolymerization reaction, whereby the UV ink hardens.

The configuration of the printer 1 will be described further below.

The computer 110 includes an interface 111, a CPU 112, and a memory 113. The interface 111 exchanges information between the printer 1 and the scanner 120. The CPU 112 performs overall control of the computer 110, and executes a variety of programs installed on the computer 110. A variety of programs and a variety of data are recorded in the memory 113. Programs installed on the computer 110 include a printer driver for converting image data outputted from an application program into print data, or a scanner driver for controlling the scanner 120. The computer 110 outputs print data generated by the printer driver to the printer 1.

The scanner 120 (corresponds to a detecting part) includes a scanner controller 125 and a read carriage 121. The scanner controller 125 includes an interface 122, a CPU 123, and a memory 124. The interface 122 performs communication with the computer 110. The CPU 123 performs overall control of the scanner 120. For example, the CPU 123 controls the read carriage 121. The memory 124 stores computer programs and other data. The read carriage 121 includes three sensors (CCDs or similar sensors; not shown) corresponding to, e.g., red (R), green (G), and blue (B).

Through the configuration described above, the scanner 120 emits light onto a medium onto which an image has been formed by the printer 1; detects resulting reflected light using each of the sensors of the read carriage 121; reads the image on the medium; and obtains color information in relation to the image. The scanner 120 then transmits data representing the color information in relation to the image (i.e., read data) to the scanner driver of the computer 110 via the interface 122. Although not shown, the scanner 120 according to the present embodiment is provided on a path along which the medium is transported in the printer 1, and is configured so as to be capable of reading an image printed on the medium when the medium is transported. The scanner 120 according to the present embodiment also detects the line width of a ruled line (raster line, described further below) printed on the medium. Details of this line-width detection will be described further below.

"Printing device" refers to the printer 1 in a narrow sense, but refers to the system including the printer 1, the computer 110, and the scanner 120 in a broader sense.

<Configuration of the Printer 1>

Figure 2:
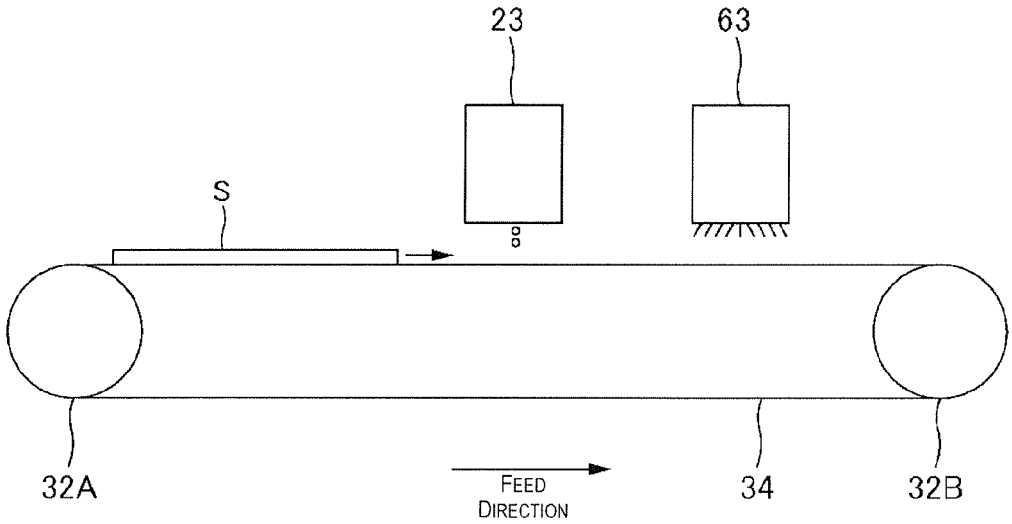
FIG. 2 is a is a schematic configuration diagram of the periphery of a print area.

Next, a description will be given for a configuration of the printer 1 with reference to FIGS. 1 and 2. FIG. 2 is a schematic configuration diagram of the periphery of a print area. In the first embodiment, the printer 1 performs monochrome printing using black (K) UV ink.

As shown in FIG. 1, the printer 1 includes a head unit 20, a feed unit 30, a detector group 40, a controller 50, and an emission unit 60. When the printer 1 receives print data from the computer 110, the controller 50 controls each of the units (i.e., the head unit 20, the feed unit 30, and the emission unit 60) based on the print data, and prints an image on the print medium. The status within the printer 1 is monitored by the detector group 40. The detector group 40 outputs to the controller 50 a signal corresponding to detection results. The controller 50 controls each of the units based on the detection results outputted from the detector group 40.

The head unit 20 is used for ejecting UV ink onto a medium (e.g., paper S). The head unit 20 ejects ink onto the medium being transported, whereby dots are formed on the medium and an image is printed on the medium. The printer 1 according to the present embodiment is a line printer, and the head unit 20 is capable of forming dots across the width of the paper at the same time. The head unit 20 according to the present embodiment includes a head 23 having a nozzle row, in which a plurality of nozzles for emitting black UV ink are arranged along the paper width direction. The nozzles are arranged along the paper width direction at a constant nozzle pitch.

Each of the nozzles forms a row of dots arranged along a direction of relative movement between the head and the medium (corresponding to a direction of intersection). The row of dots is referred to as a raster line (corresponding to a dot line). In an instance of a line printer such as in the present embodiment, "raster line" refers to a row of dots arranged in a feed direction of the paper. In contrast, in an instance of a serial printer, in which printing is performed by a head installed on a carriage, "raster line" refers to a row of dots arranged in the direction of carriage movement. A plurality of raster lines are formed in a row along the direction along which the nozzles are arranged, whereby a print image is formed. Of the raster lines, a raster line located at the nth position is referred to as an nth raster line. In the present embodiment, each of the raster lines corresponds to a nozzle on the head 23.

The feed unit 30 is for transporting the medium in a feed direction. The feed unit 30 includes an upstream-side roller 32A, a downstream-side roller 32B, and a belt 34. When a transport motor (not shown) rotates, the upstream-side roller 32A and the downstream-side roller 32B rotate, and the belt 34 rotates. The medium, which has been fed by a paper feed roller (not shown), is transported by the belt 34 to a region at which printing is possible (i.e., a region facing the head). The belt 34 transporting the paper S causes the medium to move, relative to the head unit 20, in the feed direction. After passing through the printing-enabled region, the medium is discharged to the exterior by the belt 34. During transportation, the medium is held to the belt 34 electrostatically or by vacuum chucking.

The detector group 40 includes a rotary-type encoder (not shown), a paper detection sensor (not shown), and other sensors. The rotary-type sensor detects the amount of rotation of the upstream-side roller 32A or the downstream-side roller 32B. The amount of the medium that has been transported can be detected based on a result of detection by the rotary-type encoder. The paper detection sensor detects the position of a front end of the medium during paper feed.

The controller 50 controls, using a CPU 52, each of the units of the printer 1 via a unit control circuit 54. The printer 1 has a memory 53 (corresponding to a memory part) including a memory element. The memory 53 stores a correction value table for correcting the concentration of each of the raster lines, and other data. The correction value table will be described in detail further below.

The emission unit 60 is used for emitting UV onto UV ink (i.e., dots) that has landed on the medium. The printer 1 according to the present embodiment includes an emitter 63 as the emission unit 60. The emitter 63 has a UV-emitting light source (e.g., a lamp), and is provided further downstream of the head 23 in the feed direction. UV is emitted from the emitter 63 onto the dots that are formed on the medium (i.e., dots that are formed from UV ink), whereby the dots harden.

As described further below, the emitter 63 according to the present embodiment is capable of moving along the feed direction, and the position of the emitter 63 in the feed direction is controlled by the controller 50.

<Printing Process>

In the printer 1 of such description, when the controller 50 receives the print data, first, the controller 50 causes the feed roller (not shown) to rotate using the feed unit 30, so that the medium to be printed is sent onto the belt 34. The medium is transported on the belt 34 at a constant speed without stopping, and passes under the head unit 20. While the medium passes under the head unit 20, ink is intermittently ejected from each of the nozzles of the head. Specifically, the dot formation process and the medium transportation process are performed at the same time. As a result, an image including a plurality of dots disposed along the feed direction and the paper width direction. The medium, on which the dots have been formed, next passes under the emitter 63. At this time, the controller 50 causes UV to be emitted from the emitter 63. The dots formed on the medium thereby completely harden. Finally, the controller 50 discharges the paper S on which the image has finished being printed.

<Overview of Process Performed by Printer Driver>

Figure 3:
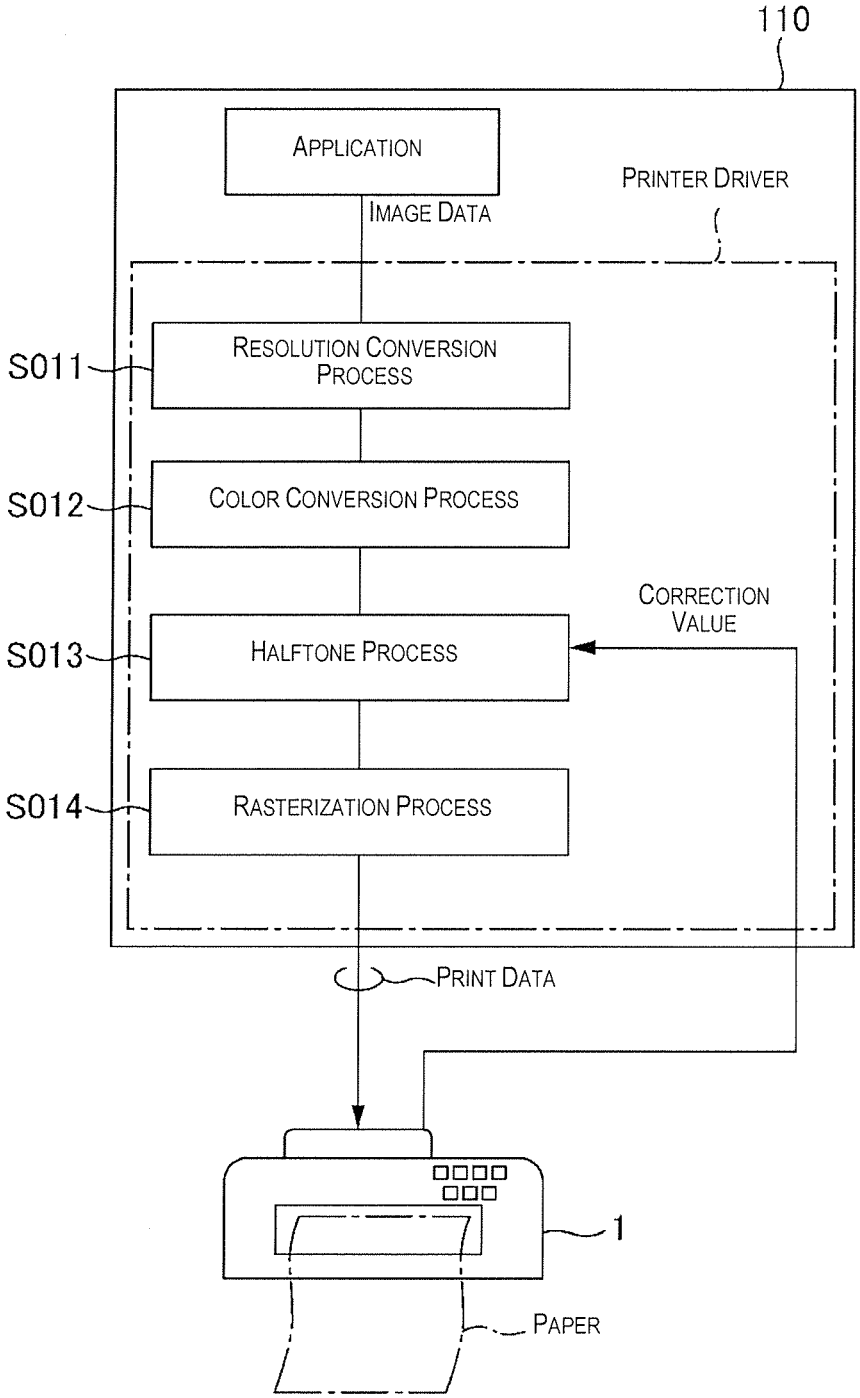
FIG. 3 is a drawing illustrating a process performed by a printer driver.

As described further above, the printing process of the above description is commenced by print data being transmitted by the computer 110 connected to the printer 1. The print data is generated by a process performed by the printer driver. The process performed by the printer driver will now be described with reference to FIG. 3. FIG. 3 is a drawing illustrating the process performed by the printer driver. The description here relates to a process in an instance in which color ink of four colors, namely cyan, magenta, yellow, and black, is used. The present embodiment relates to monochrome printing in which only one color (i.e., black) is used; therefore, only data in relation to black is generated.

As shown in FIG. 3, the print data is generated by the printer driver performing a resolution conversion process (S011), a color conversion process (S012), a half-tone process (S013), and a rasterization process (S014).

First, in the resolution conversion process, the resolution of an RGB image data obtained by execution of the application program is converted into a print resolution corresponding to a designated image quality. Next, in the color conversion process, the RGB data whose resolution has been converted is converted into a CMYK image data. Here, the CMYK image data refers to data representing the image in the respective colors of cyan (C), magenta (M), yellow (Y), and black (K). Each of the plurality of items of pixel data forming the CMYK image data is represented by a gradation value out of 256 gradation levels. This gradation value is defined based on the RGB image data, and is hereafter also referred to as an "directive tone value."

Next, in the half-tone process, the gradation values represented by the items of pixel data forming the image data, the gradation values having a large number of gradation levels, is converted into dot gradation values that can be expressed by the printer 1, the dot gradation values having a smaller number of gradation levels. Specifically, each of the gradation values out of 256 gradation levels represented by the image data is converted into a dot gradation value out of 4 gradation levels.

Specifically, each of the gradation values is converted into one of four gradation levels: "no dot" corresponding to a dot gradation value of [00]; "formation of small dot" corresponding to a dot gradation value of [01]; "formation of medium dot" corresponding to a dot gradation value of [10]; and "formation of large dot" corresponding to a dot gradation value of [11]. Next, after a dot generation rate is determined according to the size of each of the dots, dithering, gamma correction, error diffusion, or a similar method is used to form an image data so that the printer 1 forms a dot in a dispersed manner.

Next, in the rasterization process, data for each of the dots (i.e., data representing the dot gradation value) is modified into a sequence in which data is to be transferred to the printer 1, in relation to the image data obtained by the half-tone process. The data that has undergone the rasterization process is transmitted as a part of the print data.

(Inhibiting Concentration Irregularities)

Next, a description will be given with regards to concentration irregularities that occur in the image printed using the printer 1 of the above description, and a method for inhibiting the concentration irregularities.

For the purposes of the following description, a pixel region and a row region are established. A pixel region indicates a rectangular region hypothetically defined on the paper S. The size and shape are defined according to the print resolution. A single pixel forming the image data corresponds to a single pixel region. A row region is a region on the paper S including a plurality of pixel regions arranged in the feed direction. A pixel row, in which pixels are arranged in coordination with the data in a direction facing the feed direction, corresponds to a single row region.

<Concentration Irregularities>

Figure 4A:
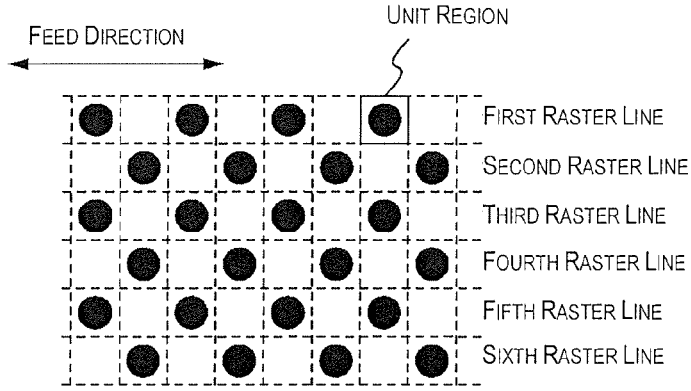
FIG. 4A is a drawing illustrating a state in which a raster line is formed in an ideal manner, FIG. 4B a drawing illustrating a state in which concentration irregularities have occurred, and (C) a drawing showing a state in which concentration irregularities are inhibited from occurring.

Next, a description will be given for the concentration irregularities with reference to the accompanying drawings. FIG. 4A is a drawing illustrating a state in which dots are formed in an ideal manner. By "the dots being formed in an ideal manner" is meant an ink droplet landing on a center position of a pixel region, the ink droplet spreading on the paper S, and a dot forming on the pixel region. When each of the dots is formed on each of the pixel regions in an accurate manner, a raster line (a dot row, in which dots are arranged in the feed direction) is formed on the row region in an accurate manner.

Figure 4B:
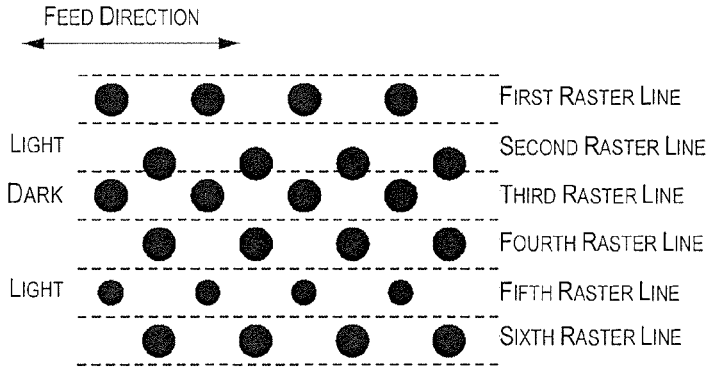

FIG. 4B is a drawing illustrating a state in which concentration irregularities have occurred. A raster line formed on the second row region is formed so as to be deflected towards the third row region due to discrepancies in the direction of flight of ink droplets ejected from the nozzles. As a result, the second row region is lighter, and the third row region is darker. Also, the amount of ink in the ink droplets ejected onto the fifth row region is less than a prescribed amount of ink, and dots formed on the fifth row region are smaller. As a result, the fifth row region is lighter.

When a print image including raster lines of varying darkness as described above is viewed from a distance, stripe-shaped density irregularities are visible along the feed direction. Density irregularities of such description cause the quality of the print image to decrease.

<Method for Inhibiting Density Irregularities>

Correcting the gradation values (i.e., directive tone values) in the image data is a possible measure for inhibiting density irregularities of the above description. Specifically, with regards to a row region that is likely to appear darker when visually observed, the gradation values in the image data corresponding to unit regions forming the row region is corrected so that the row region is formed so as to be thinner. In contrast, with regards to a row region that is likely to appear lighter when visually observed, the gradation values in the image data corresponding to unit regions forming the row region is corrected so that the row region is formed so as to be darker. Therefore, a density correction value H for correcting the gradation values in the image data is calculated for every raster line. The density correction value H is a value that reflects the density irregularity characteristics of the printer 1.

Figure 4C:
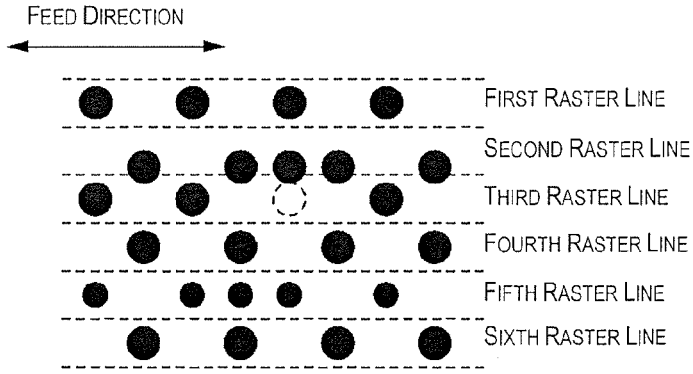

If the density correction value H for every raster line has been calculated, the printer driver performs a process for correcting the gradation values of the image data for every raster line based on the density correction value H when the half-tone process is performed. When each of the raster lines is formed according to the gradation values that have been corrected by the correction process, the density of corresponding raster lines is corrected. As a result, density irregularities are inhibited from occurring in the print image as shown in FIG. 4C. FIG. 4C is a drawing showing a state in which density irregularities are inhibited from occurring.

For example, in FIG. 4C, the gradation values in the image data for pixels corresponding to each of the row regions are corrected so that the dot generation rate of the second and fifth row regions, which appear lighter when visually observed, increases; and the dot generation rate of the third row region, which appears darker when visually observed, decreases. Thus, the dot generation rate of the raster line in each of the row regions is modified, the density of image fragments in the row regions are corrected, and density irregularities in the entire print image are inhibited.

<Calculating the Density Correction Value H>

Next, an overview will be given for a process for calculating the density correction value H for every raster line (hereafter also referred to as a correction-value-obtaining process). The correction-value-obtaining process is performed, e.g., under a correction value calculation system 200 in an inspection line of a plant in which the printer 1 is manufactured. The correction value calculation system is a system for calculating the density correction value H that corresponds to density irregularity characteristics of the printer 1, and has a substantially similar configuration to that of the printing system 100 described above. Specifically, the correction value calculation system includes a printer 1, a computer 110, and a scanner 120 (represented, for convenience, using numerals that are identical to the instance of the printing system 100).

The printer 1 is a machine that is the target of the correction-value-obtaining process. In order to use the printer 1 to print an image without density irregularities, a density correction value H for the printer 1 is calculated in the correction-value-obtaining process. The configuration and other details of the printer 1 have been described above, and a description shall not be provided here. The computer 110 placed on the inspection line is installed with a correction-value-calculating program for performing the correction-value-obtaining process.

Figure 5:
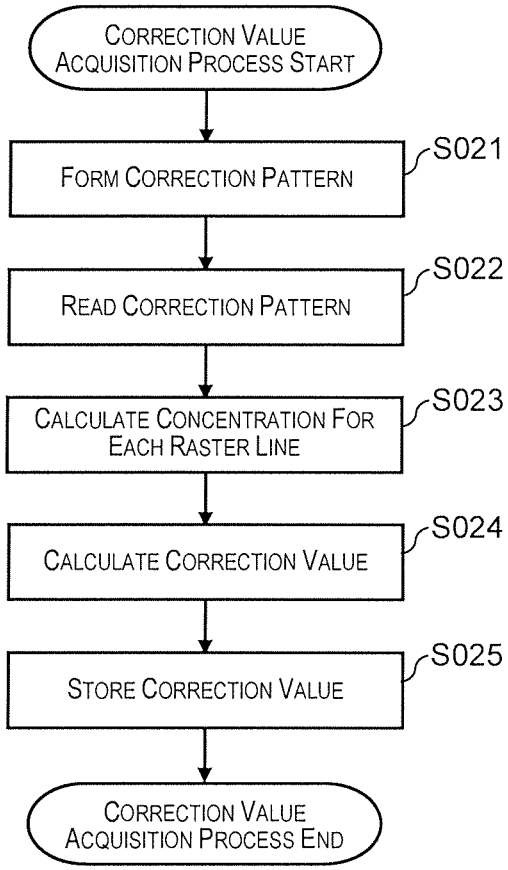
FIG. 5 is a diagram showing a flow of a correction-value-obtaining process.

An overview of a procedure for the correction-value-obtaining process will now be given with reference to FIG. 5. FIG. 5 is a diagram showing a flow of the correction-value-obtaining process. In the present embodiment, printing is performed using only black ink. Therefore, in the description below, a correction-value-obtaining process for one color (i.e., black) will be described. In an instance in which a printer that can perform multi-color printing is the target, a correction-value-obtaining process for multiple ink colors is performed using a similar procedure.

Figure 6:
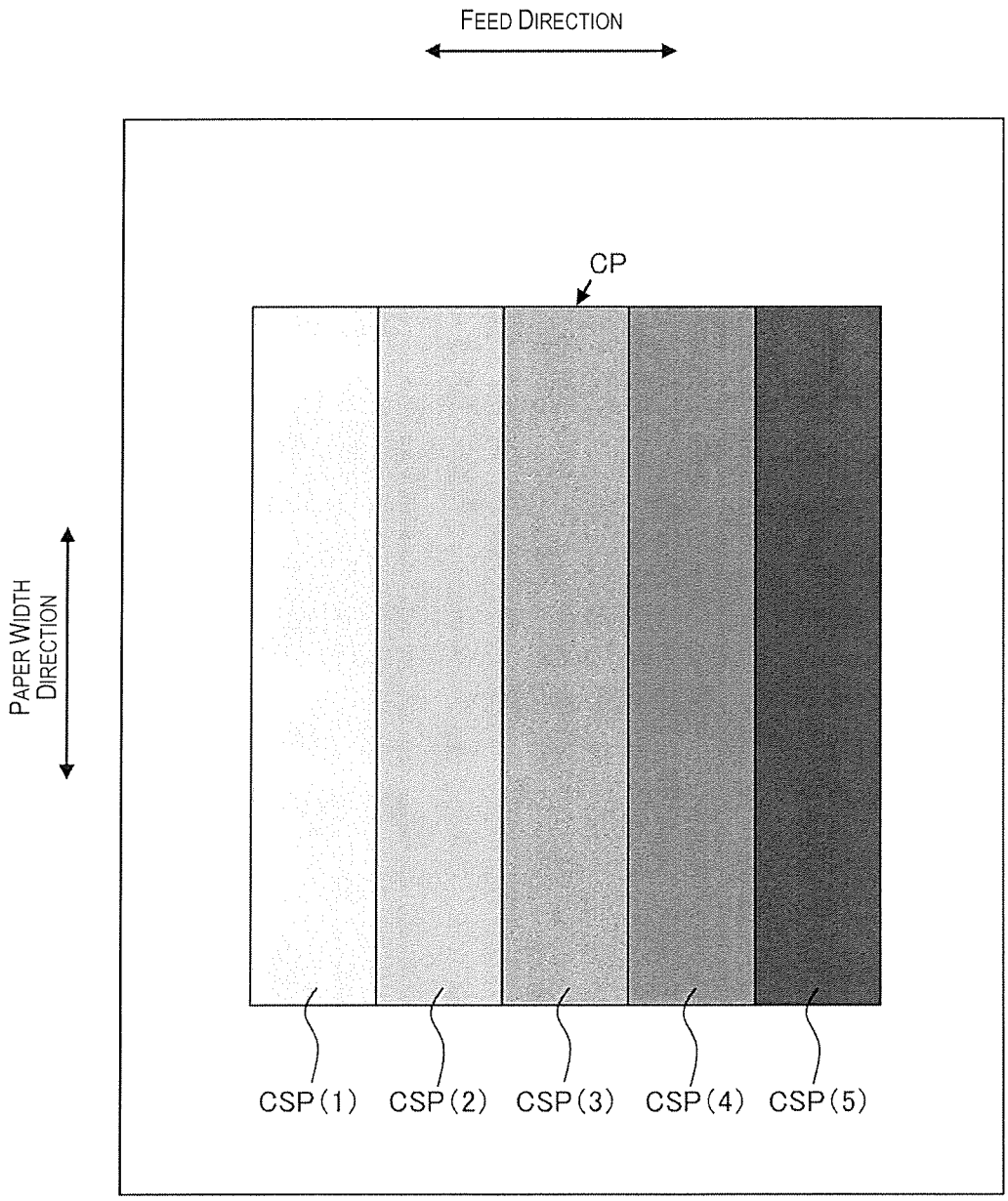
FIG. 6 is a drawing illustrating a correction pattern CP.

First, the computer 110 transmits print data to the printer 1. The printer 1 forms a correction pattern CP on the paper S using a procedure that is similar to the printing operation described above (S021). The correction pattern CP is formed from subpatterns CSP having five different densities as shown in FIG. 6. FIG. 6 is a drawing illustrating the correction pattern CP.

Each of the subpatterns CSP is a belt-shaped pattern, and is formed by a plurality of raster lines that follow the feed direction being arranged in the paper width direction. Each of the subpatterns CSP is generated from image data having constant gradation values (directive tone values), and as shown in FIG. 6, the density becomes progressively darker from the subpattern CSP on the left. Specifically, the subpatterns have a density of 13%, 27%, 40%, 60%, and 86% from left to right. In the following description, the directive tone value of the subpattern CSP having a density of 13% is represented by Sa, the directive tone value of the subpattern CSP having a density of 27% is represented by Sb, the directive tone value of the subpattern CSP having a density of 40% is represented by Sc, the directive tone value of the subpattern CSP having a density of 60% is represented by Sd, and the directive tone value of the subpattern CSP having a density of 86% is represented by Se. As shown in FIG. 6, the subpattern CSP formed at the directive tone value Sa is represented by CSP(1). Similarly, subpatterns formed at the directive tone values Sb, Sc, Sd, and Se are represented by CSP(2), CSP(3), CSP(4), and CSP(5) respectively.

Next, the computer 110 causes the scanner 120 to read the correction pattern CP printed on the paper S, and obtains corresponding results (S022). The scanner 120 has three scanners corresponding to red (R), green (G), and blue (B) as described further above, emits light onto the correction pattern CP, and detects resulting reflected light using each of the sensors. The computer 110 performs an adjustment so that, with regards to the image data generated by reading the correction pattern, the number of pixel rows, in which pixels are arranged in a direction corresponding to the feed direction, and the number of raster lines (i.e., number of row regions) forming the correction pattern become equal. In other words, the row regions and the pixel rows read by the scanner 120 are made to correspond to each other one-by-one. Then, an average value of the read gradation values indicated by each of the pixels in the pixel row that corresponds to a given row region is deemed to be a read gradation value of the corresponding row region.

Next, the computer 110 calculates a density for every raster line (in other words, for every row region) of each of the subpatterns CSP, based on the read gradation values obtained by the scanner 120 (S023). A density calculated based on the read gradation value is hereafter also referred to as a calculated density.

Figure 7:
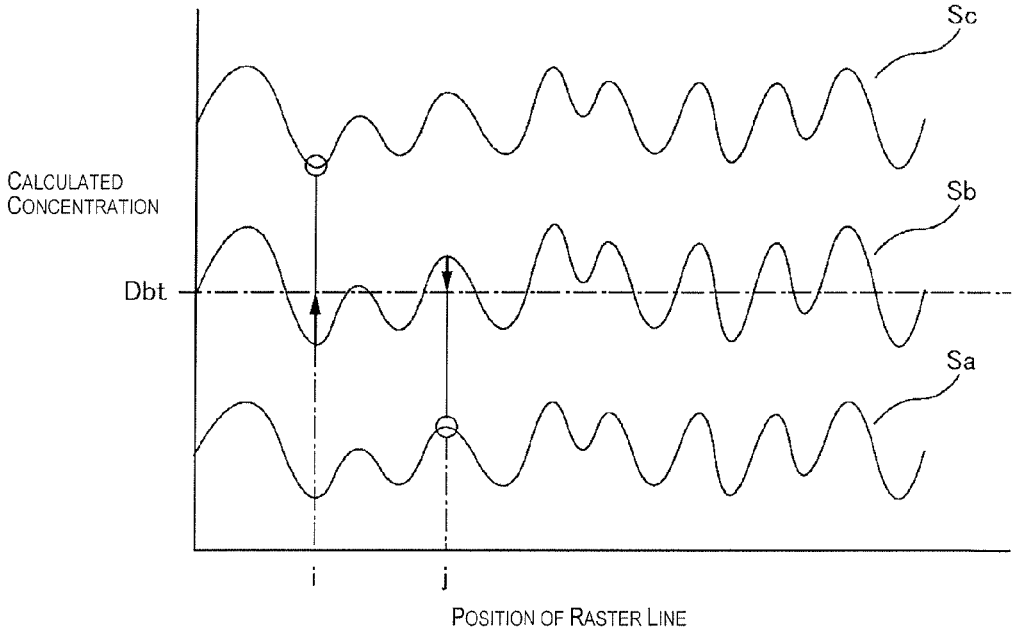
FIG. 7 is a graph indicating a calculated concentration for every raster line with regards to subpatterns CSP.

FIG. 7 is a graph indicating the calculated density for every raster line with regards to subpatterns CSP with directive tone values Sa, Sb, and Sc. In FIG. 7, the horizontal axis represents the position of raster line, and the vertical axis represents the size of the calculated densities. As shown in FIG. 7, there is a difference in density between each of the raster lines, even though each of the subpatterns CSP has been formed at a uniform directive tone value. This difference in densities of the raster lines is a cause of density irregularities in the print image.

Next, the computer 110 calculates a density correction value H for every raster line from the results of the reading performed by the scanner 120 (S024). The density correction value H is calculated for every directive tone value. The density correction value H calculated in relation to directive tone value Sa, Sb, Sc, Sd, and Se is hereafter referred to as Ha, Hb, Hc, Hd, and He respectively. In order to describe the procedure for calculating the density correction value H, a description will be given for an example of a procedure for calculating a density correction value Hb for correcting the directive tone value Sb so that the calculated density for every raster line in the subpattern CSP(2) having the directive tone value Sb becomes constant. In the procedure, for example, an average value Dbt of the calculated densities of all raster lines in the subpattern CSP(2) having the directive tone value Sb is defined as a target density of the directive tone value Sb. In FIG. 7, with regards to the ith raster line, whose calculated density is lower than the target density Dbt, the directive tone value Sb is corrected so as to be darker. In contrast, with regards to the jth raster line, whose calculated density is higher than the target density Dbt, the directive tone value Sb is corrected so as to be lighter.

Figure 8A:
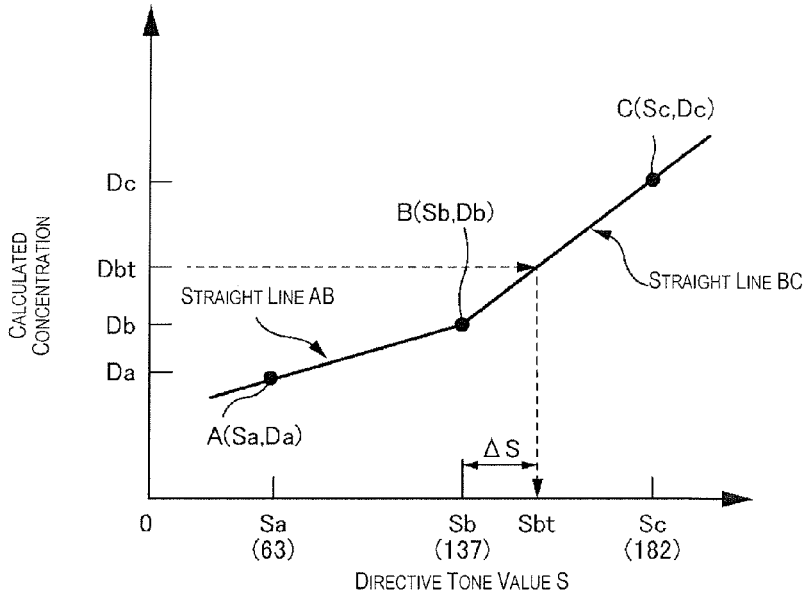
FIG. 8A is a drawing illustrating a procedure for calculating the concentration correction value Hb for correcting the directive tone value Sb in relation to the ith raster line, and FIG. 8B a drawing illustrating a procedure for calculating the concentration correction value Hb for correcting the directive tone value Sb in relation to the jth raster line.
Figure 8B:
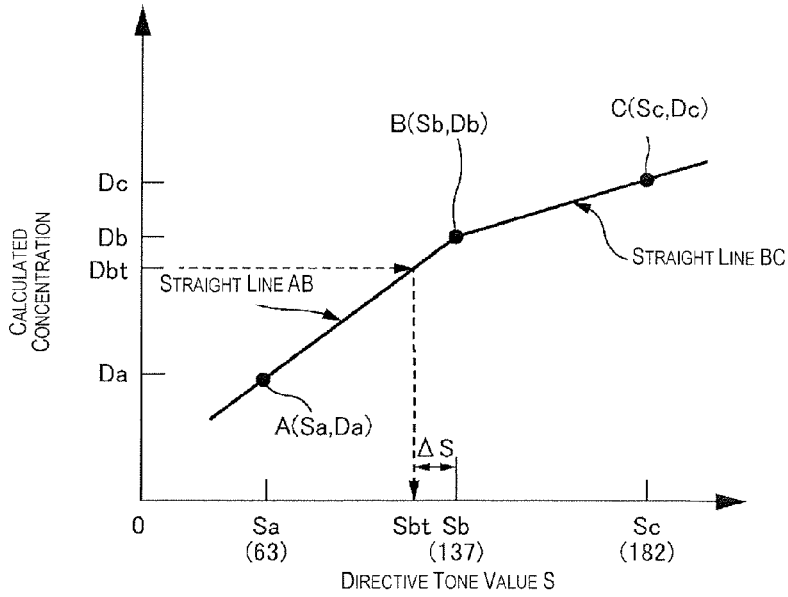

FIG. 8A is a drawing illustrating a procedure for calculating the density correction value Hb for correcting the directive tone value Sb in relation to the ith raster line. FIG. 8B is a drawing illustrating a procedure for calculating the density correction value Hb for correcting the directive tone value Sb in relation to the jth raster line. The horizontal axis of each of FIGS. 8A and 8B represents the size of the directive tone value, and the vertical axis represents the calculated density.

The density correction value Hb in relation to the directive tone value Sb of the ith raster line is calculated based on a calculated density Db of the ith raster line in the subpattern CSP(2) having the directive tone value Sb, and a calculated density De of the ith raster line in the subpattern CSP(3) having the directive tone value Sc, shown in FIG. 8A. More specifically, in the subpattern CSP(2) having the directive tone value Sb, the calculated density Db of the ith raster line is smaller than the target density Dbt. In other words, the density of the ith raster line is smaller than the average density. For the sake of argument, in order to form the ith raster line so that the calculated density Db of the ith raster line is equal to the target density Dbt, the gradation value of the image data, i.e., the directive tone value Sb corresponding to the ith raster line, is corrected to a target directive tone value Sbt calculated using the following formula (1) using linear approximation from a correspondence relationship (Sb, Db), (Se, Dc) between the directive tone value and the calculated density for the ith raster line as shown in FIG. 8A.

$$Sbt=Sb+(Sc-Sb)\times\{(Dbt-Db)/(De-Db)\} \quad \text{(Formula 1)}$$

A density correction value H for correcting the directive tone value Sb with regards to the ith raster line is obtained from the directive tone value Sb and the target directive tone value Sbt using the following formula (2).

$$Hb=\Delta S/Sb=(Sbt-Sb)/Sb \quad \text{(Formula 2)}$$

Meanwhile, the density correction value Hb in relation to the directive tone value Sb of the jth raster line is calculated based on the calculated density Db of the jth raster line in the subpattern CSP(2) having the directive tone value Sb, and the calculated density Da of the jth raster line in the subpattern CSP(1) having the directive tone value Sa, shown in FIG. 8B. More specifically, in the subpattern CSP(2) having the directive tone value Sb, the calculated density Db of the jth raster line is greater than the target density Dbt. For the sake of argument, in order to for m the jth raster line so that the calculated density Db of the jth raster line is equal to the target density Dbt, the directive tone value Sb corresponding to the jth raster line is corrected to a target directive tone value Sbt calculated using the following formula (3) using linear approximation from a correspondence relationship (Sa, Da), (Sb, Db) between the directive tone value and the calculated density for the jth raster line as shown in FIG. 8B.

$$Sbt=Sb+(Sb-Sa)\times\{(Dbt-Db)/(Db-Da)\} \quad \text{(Formula 3)}$$

The density correction value Hb for correcting the directive tone value Sb with regards to the jth raster line is then obtained from formula (2) mentioned further above.

Thus, the computer 110 calculates a density correction value Hb in relation to the directive tone value Sb for every raster line. Similarly, the computer 110 calculates density correction values Ha, Hc, Hd, He in relation to the directive tone value Sa, Sc, Sd, Se respectively, for every raster line. The computer 110 also calculates, for other ink colors, a density correction value Ha through He in relation to each of the directive tone values Sa through Se for every raster line.

The computer 110 then transmits each items of data representing the density correction value H to the printer 1, and stores the data in the memory 53 of the printer 1 (S025). As a result, a correction value table (corresponding to correction data) shown in FIG. 9, listing the density correction value Ha through He for each of the five directive tone values Sa through Se for every raster line is created in the memory 53 of the printer 1. FIG. 9 is a drawing showing the correction value table stored in the memory 53. As shown in FIG. 9, the correction value table is created for each of the ink colors. As a result, a correction value table for four colors, namely CMYK, is created. When the printer 1 is used to print an image, the correction value table is referenced by the printer driver in order to correct the gradation value of each of the raster lines forming the image data representing the image. The density correction value H is hereafter also referred to simply as a density correction value.

(Difference in Density Irregularities According to Printing Conditions)

The manner in which the ink (i.e., the dots) spread may differ according to printing condition. For example, if the type of medium is different, there is a possibility that the size of the dots (i.e., dot width) formed on the medium may differ, even for an instance in which the same amount of ink is ejected from the same nozzle. Although it is possible to inhibit density irregularities by using the correction value table described above, if the size of the dot changes, the manner in which the density irregularities appears will differ, and there is a risk of it not being possible to inhibit the density irregularities even when a correction value table that has been created in advance is used. Therefore, it is preferable to ready a plurality of correction value tables for every printing condition (e.g., type of medium). However, in order to create a correction value table, it is necessary to perform a task of the above description. Also, since density irregularities of such description are inherent for each printer, a correction value table must be created for every printer. Therefore, creating a correction value table for every printer and every medium type in the inspection line takes effort and time. Also, a larger capacity is required in the memory 53 of the printer 1 for storing the correction value tables.

Therefore, in the present embodiment, the distance between the head 23 and the emitter 63 is adjusted, whereby density irregularities are inhibited without the creation of the correction value table being repeated.

(Relationship between UV Emission and Dot Formation)

In the present embodiment, UV ink is used as the ink. After dots are formed on the medium using UV ink, UV is emitted from the emitter 63 onto the medium. Thus, ink can be fixed onto a medium, even one that does not readily absorb ink. In an instance in which UV ink is used as described above, the shape of the dots varies according to the timing at which UV is emitted.

Figure 10A:
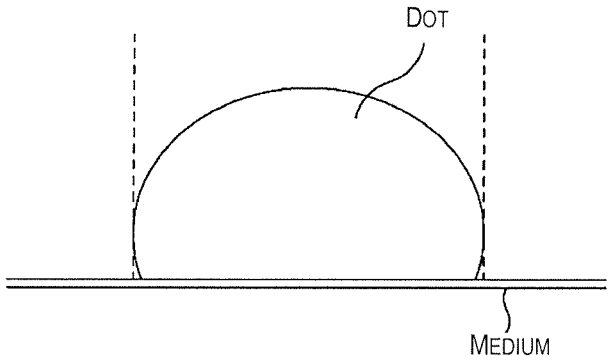
FIGS. 10A through 10C are drawings illustrating the shape of UV ink (a dot) that has landed on the medium, and the timing at which UV is emitted.
Figure 10B:
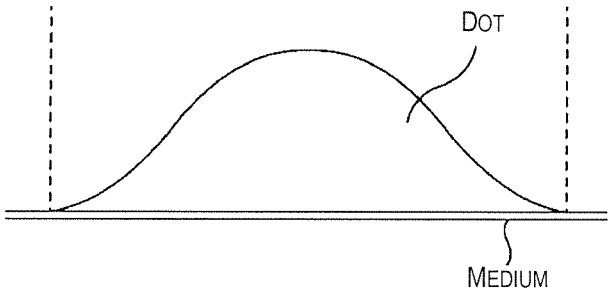
Figure 10C:
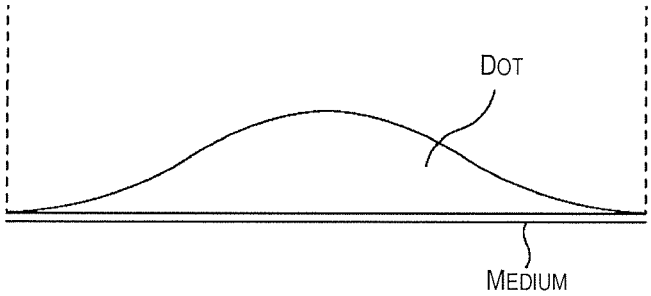

FIGS. 10A through 10C are drawings illustrating the shape of UV ink (a dot) that has landed on the medium, and the timing at which UV is emitted. The UV is emitted at progressively later timings, indicated by FIG. 10A, FIG. 10B, and FIG. 10C in the stated order.

As can be seen in the drawings, the spread of a dot formed on the medium increases, and the dot diameter increases, as the emission timing is progressively delayed. Thus, the size of the dot diameter varies according to the timing at which UV is emitted.

Therefore, in the present embodiment, in an instance in which printing is to be performed on a medium ("printing medium") that is of a different type to the medium used during creation of the correction value table, the distance between the head 23 and the emitter 63 is adjusted so that the line width of a ruled line formed by a specific nozzle is equal to the line width corresponding to the time at which the correction value table was created. However, changing the condition of the distance between the head 23 and the emitter 63 in small increments and printing a ruled line on the printing medium for every corresponding condition increases the quantity of waste sheets (i.e., wasted paper). In the present embodiment, the distance between the head 23 and the emitter 63 is adjusted so as to become optimum by using one sheet of the printing medium. Specifically, the emitter 63 is moved in the feed direction with the transportation of the medium.

[About Adjusting the Position of the Emitter 63]

Figure 11:
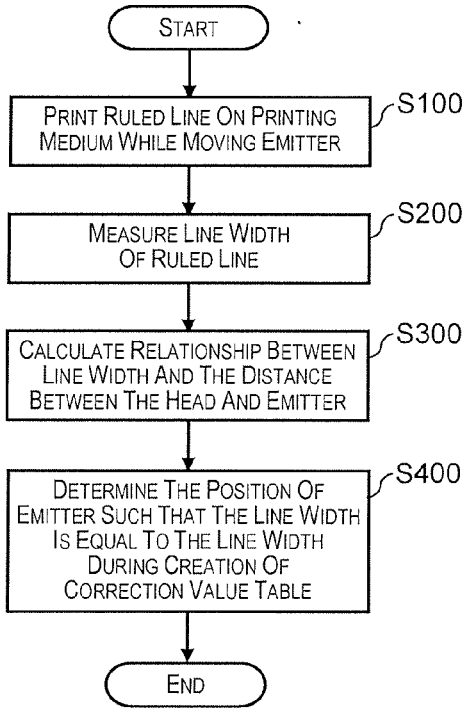
FIG. 11 is a flow diagram showing a method for adjusting the position of an emitter.
Figure 12:
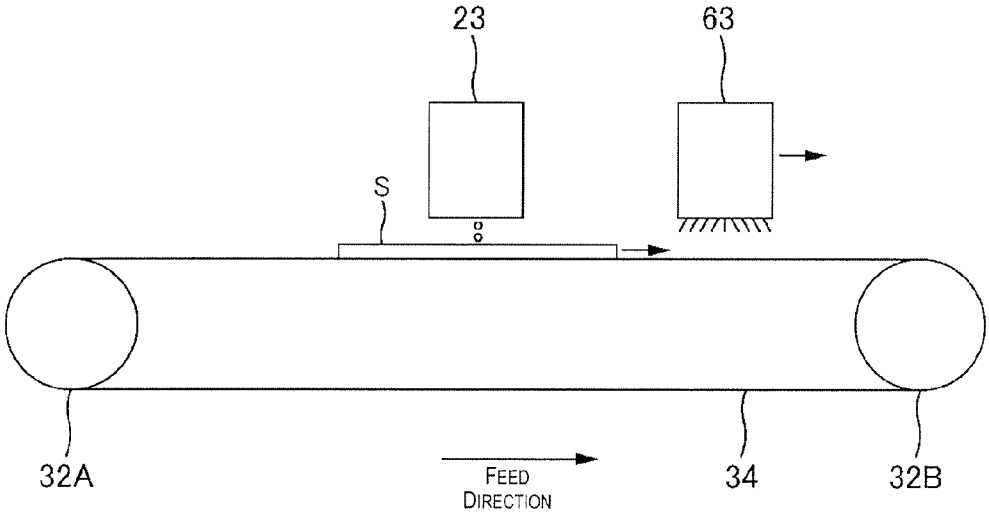
FIG. 12 is a schematic diagram illustrating the periphery of a head according to a first embodiment.

FIG. 11 is a flow diagram showing a method for adjusting the position of the emitter. The process shown in FIG. 11 is performed by the computer 110 controlling the scanner 120 and the printer 1, e.g., through the scanner driver or the printer driver of the computer 110 using one program. FIG. 12 is a schematic diagram illustrating the periphery of the head according to the first embodiment.

First, the printing medium (paper S) is positioned in the printer 1. The paper S is a medium of a different type relative to the medium used during creation of the correction value table. The computer 110 causes the printer 1 to perform printing on the paper S according to a print pattern (e.g., a 1-dot ruled line) while moving the emitter 63 in the feed direction as shown in FIG. 12 (FIG. 11, S100). Thus, in the present embodiment, UV is emitted on the paper S on which dots have been formed, while the emitter 63 is moved in the same direction as the feed direction of the paper S. The emitter 63 is controlled so as to move at a lower speed than the speed of transportation of the paper S. In other words, since the paper S is transported at a higher speed than the speed of the movement of the emitter 63, the paper S is transported so as to overtake the emitter 63. When the paper S passes under the emitter 63, UV is emitted onto the paper S from the emitter 63.

Figure 13:
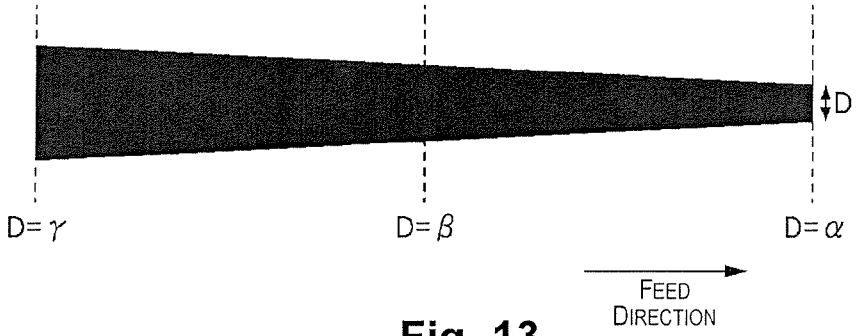
FIG. 13 is a drawing showing a ruled line formed by a specific nozzle.

FIG. 13 is a drawing showing a ruled line formed by a specific nozzle. Since the position of the head 23 is fixed and the emitter 63 moves in the feed direction, the time between dot formation and UV emission differs according to the position on the paper S. Specifically, the time between a dot being formed and UV being emitted is longer towards the downstream side of the feed direction (i.e., front end side) than towards the upstream side of the feed direction (i.e., rear end side) of the paper S. Therefore, the line width D of a ruled line (i.e., a 1-dot ruled line) printed on the paper S as shown in the drawing gradually increases from the downstream side in the feed direction to the upstream side of the feed direction (i.e., $\alpha<\beta<\gamma$). For the sake of argument, if the line width during creation of the correction value table is $\beta$, the position of the emitter 63 (in other words, the distance between the head 23 and the emitter 63) is set so that the line width D of the ruled line printed on the paper S becomes equal to $\beta$.

Figure 14:
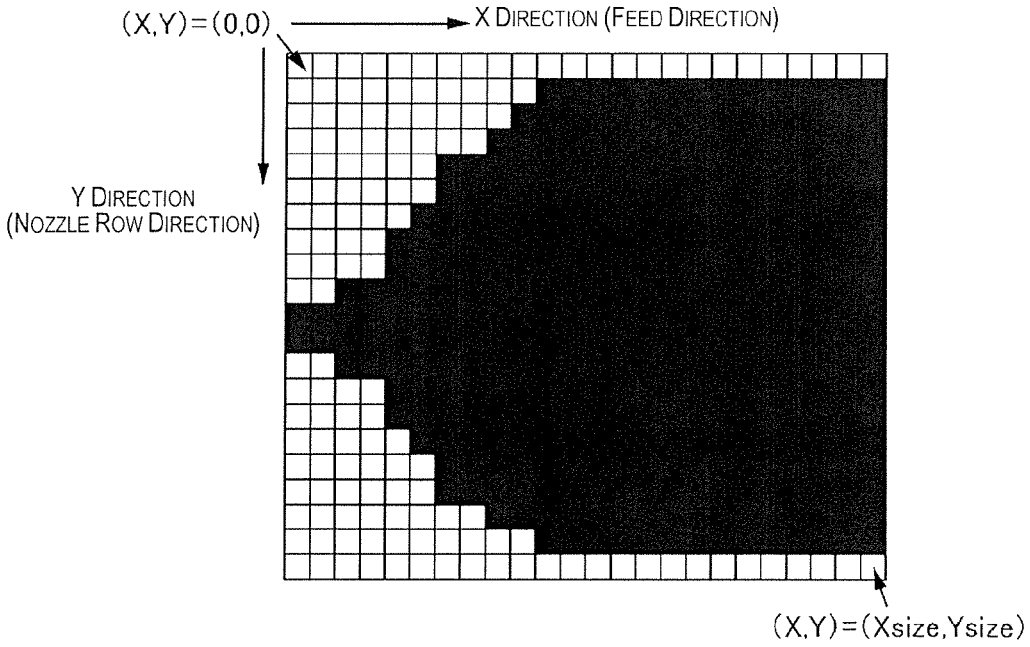
FIG. 14 is a drawing used to illustrate a reading process performed by a scanner.

Next, the computer 110 causes the scanner 120 to read the print pattern printed on the paper S (FIG. 11, S200). FIG. 14 is a drawing used to illustrate the reading process performed by the scanner 120. In the drawing, the feed direction is the x-direction, and the paper width direction is the y-direction. Each cell of a grid extending in the x-direction and the y-direction corresponds to a single pixel with regards to reading resolution (i.e., scan resolution). The line width of the ruled line when the position in the feed direction is X is referred to as Line(X).

Figure 15:
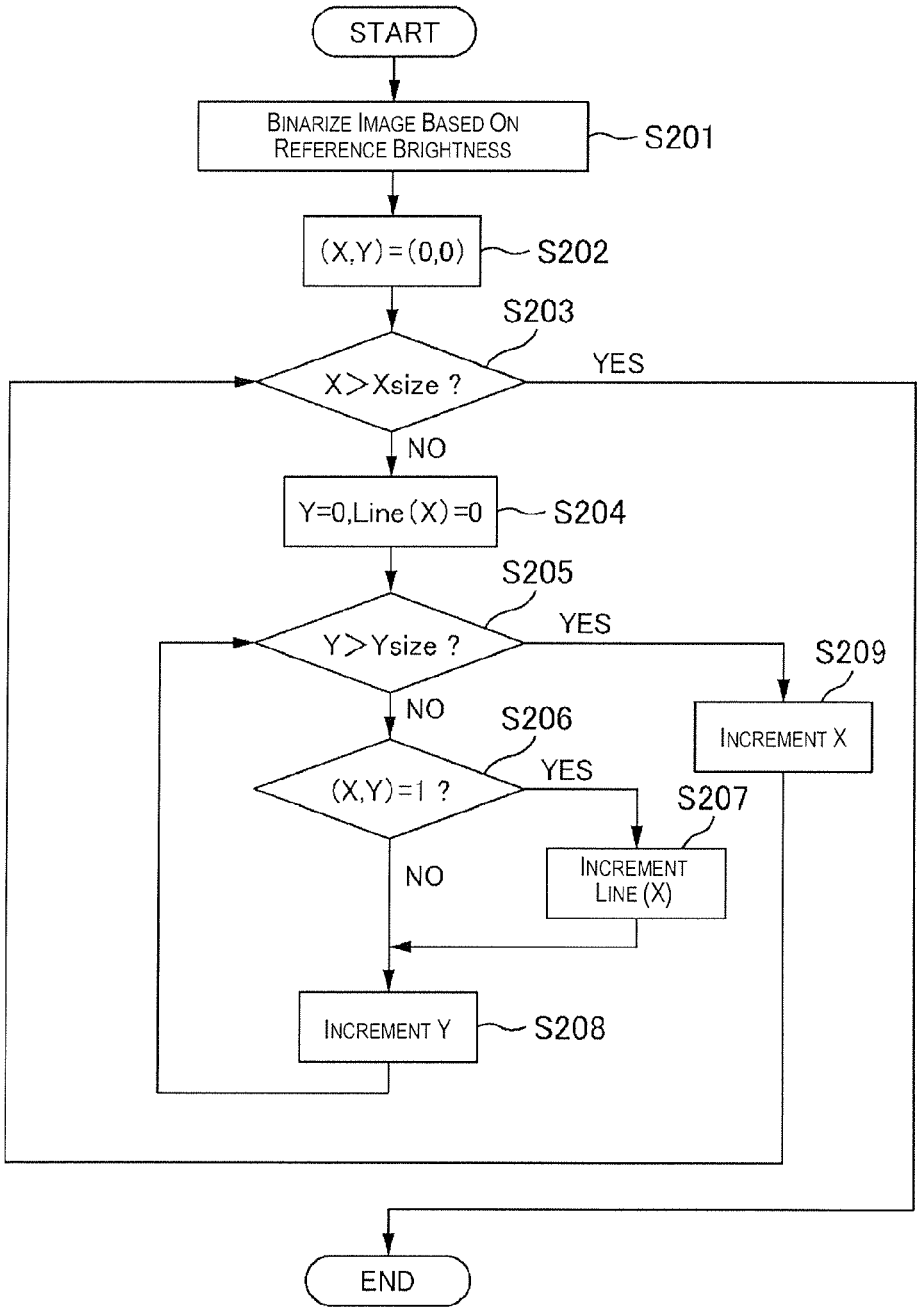
FIG. 15 is a flow diagram representing a line width measurement performed by the scanner.

FIG. 15 is a flow diagram representing the line width measurement performed by the scanner 120 in step S200 shown in FIG. 11. First, as illustrated in FIG. 14, the image is binarized based on a reference brightness (S201). Then, an origin (X, Y)=(0, 0) of the drawing is established (S202), and a scan is performed from the origin. If the value of X does not exceed a maximum value (Xsize) ("No" in S203), a pixel corresponding to Y=0 in raster line 0 is selected (S204). Since, at first, the value of Y does not exceed a maximum value (Ysize) ("No" in S205), the scanner 120 determines whether or not the brightness of the selected pixel is higher than the binarization reference brightness (S206). If the brightness of the selected pixel is lower than the reference brightness ("No" in S206), the value of Y is incremented (S208), and the flow returns to step S205. If, in step S206, the brightness of the selected pixel is higher than the reference brightness ("Yes" in step S206), the magnitude of Line(X) is incremented, and step S208 is performed in which the value of Y is incremented. Specifically, scanning is performed, a pixel at a time, in the y-direction; and as a result, the line width within which the brightness is higher than the reference brightness is calculated as Line(X).

When it is determined in step S205 that the value of Y has exceeded the maximum value ("Yes" in S205), the value of X is incremented (S209), and the flow returns to step S203 in which it is determined whether or not the value of X exceeds the maximum value. If the value of X does not exceed the maximum value ("No" in S203), a similar process is performed for the row corresponding to X.

The scanner 120 continues to perform similar processes. When it is determined in step S203 that the value of X has exceeded the maximum value (Xsize) ("Yes" in step S203), the process of measuring the line width is discontinued.

As described above, pixels that are brighter than the reference brightness are searched while the image is moved in increments in the vertical direction (i.e., y-direction) one pixel at a time. This operation is performed incrementally in the x-direction. As a result, data (Line(X)) representing the line width at each position in the x-direction can be obtained. Table 1 shows results of a measurement of the line width in positions along the x-direction.

TABLE 1

| X | 1 | 2 | 3 | 4 | 5 | 6 | 7 | 8 | 9 | 10 |
|---|---|---|---|---|---|---|---|---|---|---|
| Line (X) | 2 | 2 | 4 | 4 | 8 | 10 | 14 | 14 | 16 | 18 |

Although the values in the table represent the number of pixels, the number of pixels can be converted to length (e.g., millimeters) from the scan resolution. Also, if the speed of transportation of the medium and the speed of movement of the emitter 63 are already known, the distance between the head 23 and the emitter 63 corresponding to each position (i.e., position in the x-direction) in the pattern shown in FIG. 14 can be obtained from the results of the reading performed by the scanner 120.

Figure 16:
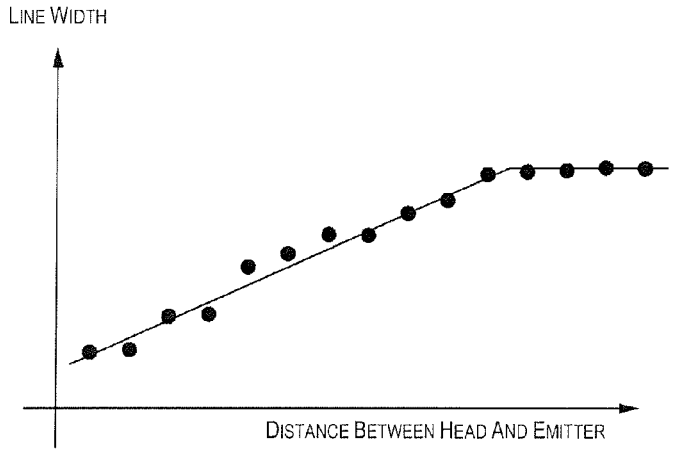
FIG. 16 is a drawing showing a relationship between the line width and the distance between the head and the emitter.

FIG. 16 is a drawing showing a relationship between the line width and the distance between the head 23 and the emitter 63 shown in Table 1. The horizontal axis in the drawing represents the distance between the head 23 and the emitter 63, and the vertical axis represents the line width. The computer 110 performs linear interpolation on the results of the reading performed by the scanner 120 (Table 1) and obtains a relationship between the line width and the distance between the head 23 and the emitter 63.

Thus, the computer 110 calculates the relationship between the line width of the ruled line and the distance between the head 23 and the emitter 63 based on the results of the reading performed by the scanner 120 (FIG. 11, S300).

Using the obtained relationship (i.e., the relationship between the line width of the ruled line and the distance between the head 23 and the emitter 63), the computer 110 then sets the position of the emitter 63 of the printer 1 so that the line width of the ruled line is equal to the line width stored in the memory 53 (i.e., line width during creation of the correction value table).

As described above, in the present embodiment, the emitter 63 is moved in the feed direction when the paper S is transported. In other words, the distance between the head 23 and the emitter 63 is varied. The relationship between the line width of the ruled line and the distance between the head 23 and the emitter 63 is obtained from the results of reading the line width of the ruled line formed as described above, and the position of the emitter 63 is adjusted so that the line width of the ruled line is equal to the line width during creation of the correction value table. Thus, the need to repeatedly create the correction value table according to the printing conditions is obviated, and it becomes possible to minimize concentration irregularities using one correction value table. Also, in the present embodiment, the amount of paper S used to adjust the distance between the head 23 and the emitter 63 can be reduced, and it becomes possible to prevent paper S from being wastefully consumed during condition adjustment.

The present embodiment is configured using a system including the printer 1, the computer 110, and the scanner 120, but may also be configured using the printer 1 and the scanner 120, or a system in which the printer 1, the computer 110, and the scanner 120 are configured in an integral manner.

<Modification Example>

In the embodiment described above, the emitter 63 is moved in the feed direction of the medium during printing. However, the emitter 63 may also be moved in the direction opposite the feed direction (i.e., leftward in the drawings). In such an instance, the distance between the head 23 and the emitter 63 gradually decreases. Therefore, the time between dot formation and UV emission gradually decreases. Specifically, the line width of the raster lines formed on the medium is thicker towards the downstream side in the feed direction, and lighter towards the upstream side in the feed direction (i.e., a relationship opposite that shown in FIG. 12). In such an instance, the distance between the head 23 and the emitter 63 is again adjusted so as to result in a line width that is stored in the memory 53.

Alternatively, the emitter 63 may be fixed, and the head 23 may be moved in the feed direction (or the direction opposite the feed direction). In other words, it is possible for either the head 23 or the emitter 63 to move in a relative manner with respect to each other. Thus, the amount of paper S used for adjustment can be reduced, and it becomes possible to prevent paper S from being wastefully consumed during condition adjustment.

(Second Embodiment)

According to the embodiment described above, monochrome printing is performed using black ink (K) only. However, in the second embodiment, color printing is performed. In the second embodiment, printing is again performed on a printing medium (i.e., paper S) which is different to the medium during creation of the correction value table. Also, in the second embodiment, a correction value table such as that shown in FIG. 9 is created and stored in the memory 53 for every ink color.

Figure 17:
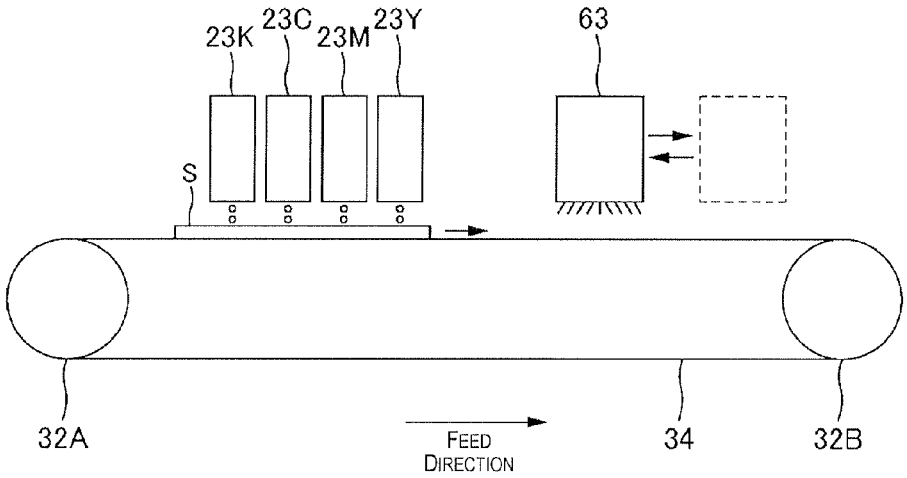
FIG. 17 is a schematic diagram illustrating the periphery of heads according to a second embodiment.

FIG. 17 is a schematic diagram illustrating the periphery of heads according to the second embodiment. In the second embodiment, configurations other than the head section are identical to those in the first embodiment, and a description shall not be provided.

The printer 1 according to the second embodiment includes, in sequence from the upstream side of the feed direction, a black ink head 23K for ejecting black ink (K), a cyan ink head 23C for ejecting cyan ink (C), a magenta ink head 23M for ejecting magenta ink (M), and a yellow ink head 23Y for ejecting yellow ink (Y). The configuration of each of the heads is identical to the head 23 according to the first embodiment. Each of the heads has a nozzle row in which nozzles for ejecting UV ink are arranged in the paper width direction. An emitter 63 is provided further downstream in the feed direction relative to the yellow ink head 23Y. As with the first embodiment, the emitter 63 is capable of moving along the feed direction.

When paper S is transported in the feed direction, the paper S passes under the black ink head 23K, the cyan ink head 23C, the magenta ink head 23M, and the yellow ink head 23Y, in the sequence mentioned. At this time, the controller 50 causes ink (UV ink) to be ejected from the heads. A color image is thereby formed from CMYK UV ink on the paper S. Then, the controller 50 causes the emitter 63 to emit UV when the paper S passes under the emitter 63. Dots formed on the paper S are thereby hardened and fixed.

In the second embodiment, the distance to the emitter 63 is different for every one of the heads for different colors, as can be seen from the drawing. Specifically, when ruled lines are printed, the line width will differ between each of the colors, even if the same amount of ink is ejected from each of the heads.

Therefore, in the second embodiment, the line width is adjusted by varying a driving voltage (or driving waveform) of the head between every color (i.e., every head). The position of the emitter 63 is defined in relation to a head that is substantially central (e.g., the cyan ink head 23C) using a process that is the same as the first embodiment. Specifically, the position of the emitter 63 is defined so that the line width of a cyan ruled line is equal to a predetermined line width (i.e., the line width during creation of the correction value table). In the following embodiment, the line width of a color other than cyan (i.e., black), from among the four colors, is adjusted.

Figure 18:
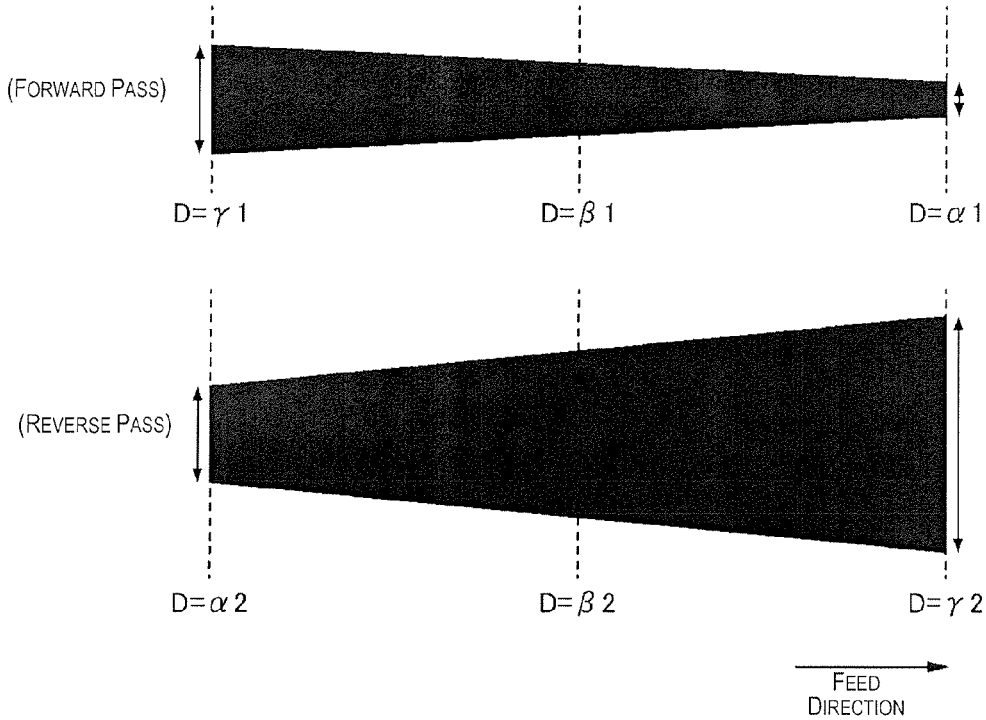
FIG. 18 is a drawing used to illustrate adjustment of the line width according to the second embodiment.

FIG. 18 is a drawing used to illustrate adjustment of the line width according to the second embodiment. The line shown is a ruled line formed by the black ink head 23K, printed while the emitter 63 is moved as with the first embodiment. However, in this instance, the emitter 63 is moved in a reciprocating manner along the feed direction. The driving voltage of the black ink head 23K is varied between a forward pass and a reverse pass. For example, during the forward pass, the black ink head 23K is driven at a driving voltage 1; and during the reverse pass, the black ink head 23K is driven at a driving voltage 2, which is higher than the driving voltage 1. In other words, the ink weight of ink droplets ejected from the black ink head 23K is different between the forward pass and the reverse pass.

For example, in FIGS. 18, α1 and α2 represent line widths when the position of the emitter 63 in the feed direction is the same between the forward pass and the reverse pass. As shown in the drawing, the line width of the ruled line for the reverse pass, formed at driving voltage 2 (i.e., α2), is larger than the line width of the ruled line for the forward pass, formed at driving voltage 1 (i.e., α1). Similarly, β1 and β2 also represent line widths when the position of the emitter 63 in the feed direction is the same. In this instance, again, the line width of the ruled line for the reverse pass (i.e., β2) is larger than the line width of the ruled line for the forward pass (i.e., β1). A similar relationship also exists between γ1 and γ2).

For the sake of argument, supposing that the distance between the cyan ink head 23C and the emitter 63 (i.e., the position of the emitter 63) is set by an evaluation that is similar to that in the first embodiment, if β1 is the line width during the forward pass (i.e., driving voltage 1) and β2 is the line width during the reverse pass (i.e., driving voltage 2 ) of the black ruled line corresponding to this position of the emitter 63, the driving voltage at which the line width has a target dimension can be obtained by linear interpolation from the relationship between the driving voltage and the line width.

Thus, even in an instance in which the position of the emitter 63 has been defined based on the distance to the cyan ink head 23C, from among the four heads, changing the driving voltage of the black ink head 23K (i.e., changing the amount of ejected ink) makes it possible to adjust the line width of the black ruled line. Specifically, the line width of the black ruled line can be adjusted to the line width during creation of the correction value table. Accordingly, it is possible to adjust the line width using the driving voltage and thereby inhibit concentration irregularities in relation to black ink. A similar adjustment can be made in relation to ink having other colors (i.e., magenta and yellow).

In the second embodiment as well, each of the heads can be moved in a reciprocating manner, instead of the emitter 63. In other words, the head and the emitter 63 need only move relative to each other.

(Third Embodiment)

In the embodiment described above, the emitter 63 is moved in the feed direction during printing of the ruled line. However, in the third embodiment, the position of the emitter 63 is defined based on tilting the emitter 63 diagonally relative to the paper width direction (i.e., the direction along which the nozzles are arranged) during printing of the ruled line. As with the first embodiment, ink of only one color (e.g., black) is used in the third embodiment.

Figure 19:
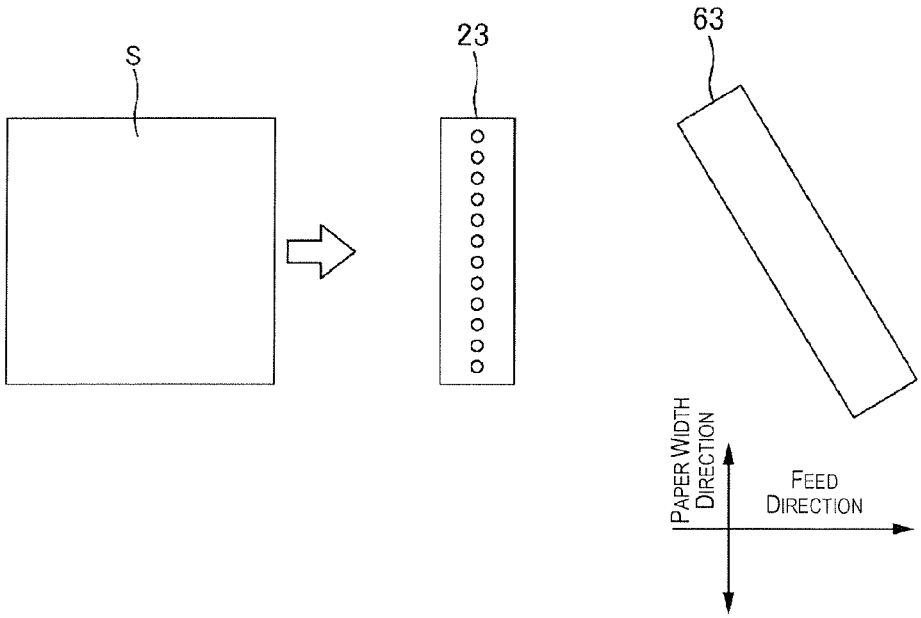
FIG. 19 is a schematic diagram illustrating the periphery of a head according to a third embodiment.

FIG. 19 is a schematic diagram illustrating the periphery of a head according to a third embodiment. FIG. 19 is a drawing showing the surroundings of the head as viewed from above (i.e., above a print surface).

In the third embodiment, the emitter 63 is tilted diagonally relative to the paper width direction when the ruled line is printed, as shown in FIG. 19. Therefore, the distance between the head 23 and the emitter 63 is smaller for positions further above in the drawing, and the distance between the head 23 and the emitter 63 is greater for positions further below in the drawing. In this state, a plurality of nozzles in the head 23 are used to print a plurality of ruled lines.

Figure 20:
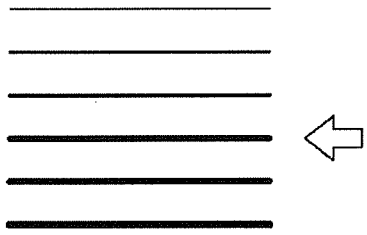
FIG. 20 is a drawing illustrating ruled lines printed in the third embodiment.

FIG. 20 is a drawing illustrating the ruled lines printed in the third embodiment. As described above, the emitter 63 is tilted; therefore, the time between dot formation and UV emission differs according to position of the paper S. For example, in positions further above in the drawing, the distance between the head 23 and the emitter 63 is shorter; therefore, the time between dot formation and UV emission is shorter, and the line width of a ruled line is smaller. In contrast, in positions further below in the drawing, the distance between the head 23 and the emitter 63 is longer; therefore, the time between dot formation and UV emission is longer, and the line width of a ruled line is larger.

Figure 21:
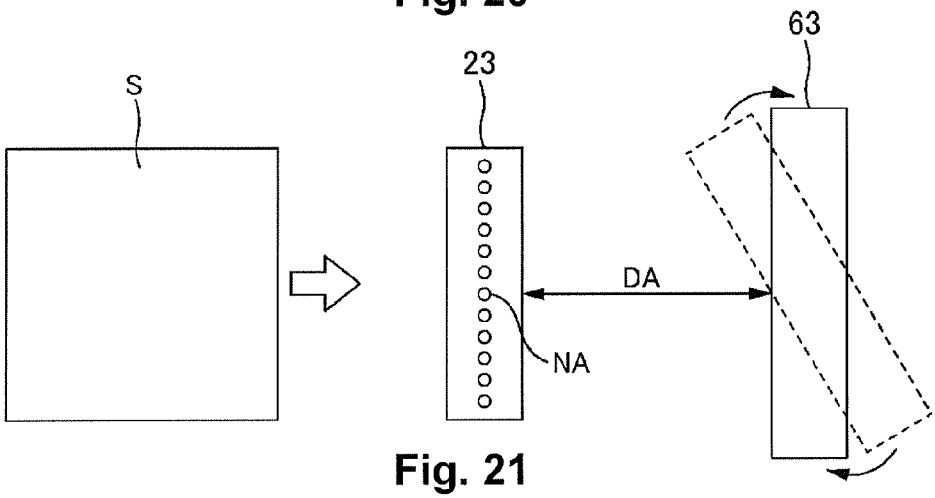
FIG. 21 is a drawing illustrating a method for adjusting the distance between the head and the emitter according to the third embodiment.

FIG. 21 is a drawing illustrating a method for adjusting the distance between the head and the emitter according to the third embodiment.

It shall be supposed that the line width of the raster line indicated by the arrow in FIG. 20 is the target line width (line width during creation of the correction value table) as a result of using the scanner 120 to read the line widths of the ruled lines shown in FIG. 20, and that this raster line is one that has been formed by a nozzle NA in the head 23. In this instance, the controller 50 causes the emitter 63 to rotate so that the distance between the head 23 and the emitter 63 becomes equal to the distance (DA) between the head 23 and the emitter 63 at the position of nozzle NA as shown in FIG. 21. It is thereby possible to adjust the distance between the head 23 and the emitter 63 so that the line width of the ruled line formed on the paper S is equal to the line width during creation of the correction value table.

Thus, in the third embodiment, the distance between the head 23 and the emitter 63 can be adjusted in a simple manner, merely by printing ruled lines in a state in which the emitter 63 is tilted diagonally relative to the paper width direction (i.e., the direction along which the nozzles are arranged). It is thereby possible to use a correction value table to reduce concentration irregularities, even in an instance in which printing is performed on a printing medium of a different type to the medium used when the correction value table was created.

(Fourth Embodiment)

Figure 22:
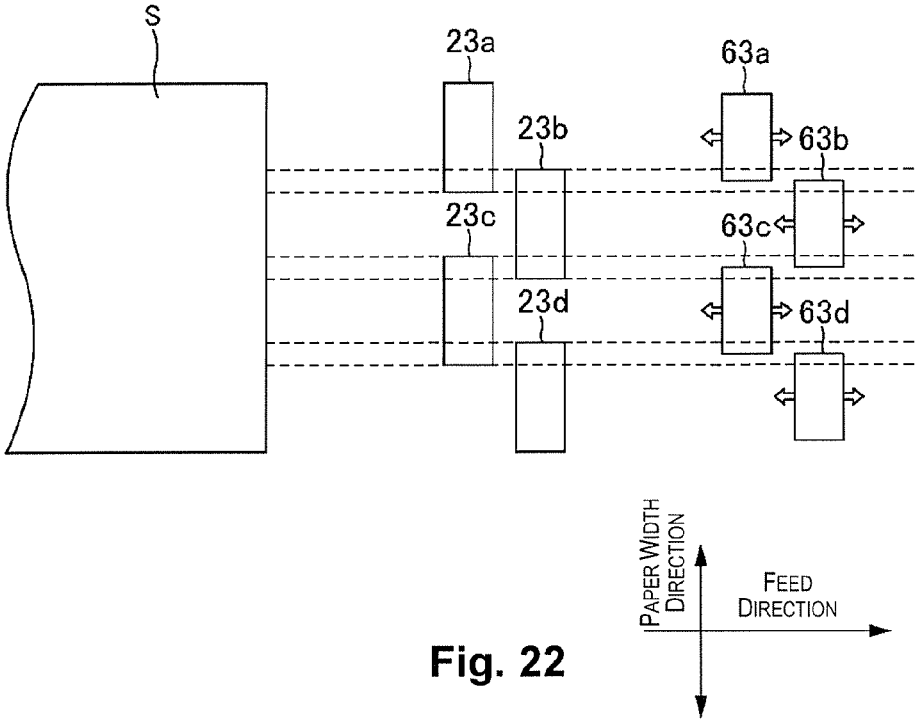
FIG. 22 is a schematic diagram illustrating the periphery of heads according to a fourth embodiment.

FIG. 22 is a schematic diagram illustrating the periphery of heads according to a fourth embodiment. FIG. 22 is a drawing showing the periphery of the heads as viewed from above.

As shown in the drawing, in the fourth embodiment, a plurality of heads (heads 23*a* through 23*d*) are arranged in a staggered manner along the paper width direction. Although not shown, a nozzle row, in which a plurality of nozzles for ejecting UV ink are arranged at a constant nozzle pitch, are formed on each of the heads.

Emitters 63*a* through 63*d* are provided further downstream in the feed direction in relation to the heads 23*a* through 23*d* so as to correspond to each of the heads. Each of the emitters 63*a* through 63*d* is capable of moving in the feed direction in an independent manner.

In such an instance, as with the previous embodiments, it is possible to minimize discrepancies between heads by adjusting the respective position of each of the emitters (i.e., the distance between each of the heads and each of the emitters).

However, in an instance in which the size (i.e., length in the paper width direction) of an emitter is equal to or larger than the length of a head in the paper width direction, the range of movement of the emitters becomes limited. Specifically, if, in FIG. 22, the size of each of the emitters is equal to or larger than the length of each of the heads in the paper width direction, it is not possible to, e.g., move the emitter 63*b* to the left (i.e., further upstream in the feed direction) of the emitter 63*a* (and emitter 63*c*).

In such an instance, if L represents the length of each of the heads, N represents the number of heads, and L represents the overlap length, the length of an emitter must be 1/N[L×N−{1×(N−1)}]. L×N−{1×(N−1)} corresponds to the width of a print region for N heads.

For example, if in FIG. 22, the length of a head in the paper width direction is 2.2 inches, and the overlap amount is 0.1 inch, the width of a print area for four heads is 2.2×4−(0.1×3)=8.5 inches. Dividing this by the number of heads (i.e., four) results in 8.5/4=2.125 inches, which is the length of each of the emitters (i.e., length in the paper width direction). It thereby becomes possible to inhibit discrepancies between heads using emitters having the same configuration.

(Other Embodiments)

Although descriptions have been given in relation to a printer and other devices as embodiments, the embodiments described above are intended to facilitate understanding of the invention, and are not intended to limit interpretation of the invention. It shall be apparent that the invention may be modified or amended without departing from its scope, and that the invention includes equivalents thereof. In particular, the following embodiments are also included in the invention.

<Printer>

In the above embodiments, a line head printer in which nozzles are arranged in a paper width direction which intersects the feed direction of the medium is given as an example; however, this printer is not provided by way of limitation. For example, a printer which repeats a dot-forming operation and a transporting operation (i.e., a moving operation) in an alternating manner (i.e., a serial printer) is also possible; the dot-forming operation being an operation in which a dot row is formed along a direction of movement of a head unit while the head unit is moved along the direction of movement that intersects the direction of a nozzle row (i.e., along the paper width direction), and the transporting operation being an operation in which the medium is transported in the feed direction, which is the direction of the nozzle row. In such an instance, e.g., a carriage that moves independently in relation to a carriage for moving the head is provided further downstream in the direction of head movement, and the speed of movement of the head and the speed of movement of a light source are caused to differ in relation to each other (specifically, the speed of movement of the light source is caused to be less than the speed of movement of the head). Thus, the time between dot formation and UV emission is different according to the position of the medium in the paper width direction, and it is therefore possible to print a ruled line similar to that shown in FIG. 13 along the paper width direction of the medium.

Also, an ink ejection method for ejecting ink from nozzles provided to the printer 1 may be a piezo method in which piezo elements are driven to expand/contract ink chambers, or may be a thermal method in which a heating element is used to generate air bubbles in the nozzles and ejecting ink using the air bubbles.

<Scanner>

In the embodiment described above, the scanner 120 used is a sensor type, which has each of R, G, and B sensors (e.g., CCDs), and in which light produced by reflection of light emitted onto a document is read by each of the sensors, whereby color information for R, G, and B is obtained; however, this is not provided by way of limitation. For example, a light-source-switching type, in which R, B, and G fluorescent lamps are caused to illuminate in a sequential manner, reflected light is read using a monochrome image sensor, and color information for R, G, and B is obtained; or a filter-switching type, in which R, G, and B color filters are provided between a light source and a sensor, and the color filters are switched in a sequential manner, whereby color information for R, G, and B is obtained, may also be used.

Also, a device other than a scanner may be used to measure the line width of a ruled line.

<UV ink>

In the embodiments described above, ink that hardens when subjected to emission of ultraviolet rays (UV) (i.e., UV ink) is ejected from the nozzles. However, the liquid ejected from the nozzles is not limited to ink that hardens under UV light, and may also be ink that hardens under visible light. In this instance, visible light having a wavelength in which the ink hardens is emitted from the emitter 63.

<Measurements of Line Width>

In the embodiments described above, the line width of a 1-dot ruled line (i.e., a single raster line) is measured. However, this is not provided by way of limitation; the line width of, e.g., a 2-dot ruled line (i.e., two raster lines that are adjacent to each other) may be measured instead. In this instance, the line width in relation to the two raster lines is measured in advance when the correction table is created.

What is claimed is:

1. A printing device, comprising a head having a nozzle row in which a plurality of nozzles for ejecting ink that hardens under emission of light are arranged in a predetermined direction, the head being adapted for ejecting the ink from the nozzle row onto a medium that undergoes a relative movement in an intersecting direction that intersects the predetermined direction, thereby forming in the predetermined direction a plurality of dot lines, in which a plurality of dots are arranged in the intersecting direction;

a light source for emitting light onto the dots formed on the medium by the head;

an adjusting part for adjusting a distance between the head and the light source;

a detecting part for detecting a dot width, in the predetermined direction, of a given dot line; and a memory part for storing correction data, in which a concentration correction value is defined for every dot line, and a dot width, in the predetermined direction, of the given dot line in relation to when the correction data was created; wherein the distance between the head and the light source is adjusted so that the dot width detected by the detecting part becomes equal to the dot width stored in the memory part.

2. The printing device according to claim 1, wherein the given dot line is formed on the medium while the head and the light source are moved, relative to each other, in the intersecting direction.

3. The printing device according to claim 2, wherein a driving voltage differs between a forward pass and a reverse pass with regards to the relative movement of the head and the light source in the intersecting direction.

4. The printing device according to claim 2, wherein the speed of movement of the light source is less than the speed of movement of the head.

5. The printing device according to claim 1, wherein a plurality of the heads are provided so as to be arranged in the intersecting direction; and the distance between a given head, from among the plurality of heads arranged in the intersecting direction, and the light source is adjusted.

6. The printing device according to claim 5, wherein an amount of ink ejected from a head other than the given head is modified according to the distance between the given head and the light source.

7. The printing device according to claim 6, wherein the given head and the head other than the given head have different driving voltages or driving waveforms.

8. The printing device according to claim 6, wherein the given head is a head positioned at a center in the intersecting direction, from among the plurality of heads arranged in the intersecting direction.

9. The printing device according to claim 1, wherein the light source is tilted so that the distance from the head differs towards one end and towards another end in the predetermined direction, a plurality of dot lines are formed by the nozzles of the nozzle row, a respective dot width of each of the dot lines is detected by the detecting part, and the distance between the head and the light source is adjusted based on a result of the detection.

10. The printing device according to claim 1, wherein a plurality of the heads are provided in the predetermined direction;

the light source is provided in the predetermined direction so as to correspond to each of the heads; and each of the respective distances between a corresponding head and light source is adjusted.

11. A method of printing using a printing device comprising a head having a nozzle row in which a plurality of nozzles for ejecting ink that hardens under emission of light are arranged in a predetermined direction, the head being adapted for ejecting the ink from the nozzle row onto a medium that undergoes a relative movement in an intersecting direction that intersects the predetermined direction, thereby forming in the predetermined direction a plurality of dot lines, in which a plurality of dots are arranged in the intersecting direction;

a light source for emitting light onto the dots formed on the medium by the head; and a memory part; the method of printing characterized in comprising:

storing in the memory part correction data, in which a concentration correction value is defined for every dot line, and a dot width, in the predetermined direction, of a given dot line in relation to when the correction data was created;

detecting a dot width, in the predetermined direction, of the given dot line formed on a printing medium; and adjusting a distance between the head and the light source so that the detected dot width becomes equal to the dot width stored in the memory part.

* * * * *